United States Patent [19]

Perakh et al.

[11] 4,234,396

[45] Nov. 18, 1980

[54] CHROMIUM PLATING

[76] Inventors: Mark Perakh, 110 E. Talpiot; Hana Ginsburg, 413 Neve Yaacov; Erna Salomon, 2/9 Mavo Kzia St.; Valentina Shargorodsky, 28/6 Ramot; Liuba Rubinstein, 116/19 Chevroni St., all of Jerusalem, Israel

[21] Appl. No.: 18,365

[22] Filed: Mar. 7, 1979

[30] Foreign Application Priority Data

Mar. 8, 1978 [IL] Israel ..... 54230
Mar. 8, 1978 [IL] Israel ..... 54231

[51] Int. Cl.[3] ..... C25D 3/06
[52] U.S. Cl. ..... 204/51
[58] Field of Search ..... 204/51

[56] References Cited

U.S. PATENT DOCUMENTS

| | | | |
|---|---|---|---|
| 1,581,188 | 4/1926 | Fink | 204/51 |
| 3,475,295 | 10/1969 | Smith | 204/51 |
| 3,706,636 | 12/1972 | Bride | 204/51 |
| 3,706,638 | 12/1972 | Bride | 204/51 |
| 3,706,642 | 12/1972 | Brannan | 204/51 |

OTHER PUBLICATIONS

Modern Electroplating, Edited by Frederick Lowenheim, 2nd Edition, 1963, pp. 80–99, 128–133.

*Primary Examiner*—T. M. Tufariello
*Attorney, Agent, or Firm*—Browdy and Neimark

[57] ABSTRACT

The present invention relates to a plating bath for electroplating various metals with chromium, prepared from 100 g to 1600 g chromium trioxide per liter, 0.3 weight percent to 15 weight percent Cl (chlorine or chloride ions) calculated on the chromium trioxide, and/or 0.3 to 10 weight percent I (iodine and/or iodide ions) calculated on the chromium trioxide said plating bath optionally containing also from 0.3 weight percent to 2 weight percent sulfate ions calculated on the chromium trioxide, and to a process of electroplating of metals from such plating baths, which is effected at a temperature between room temperature and about 60° C. at a current density from 10 A/dm$^2$ to about 270 A/dm$^2$.

12 Claims, No Drawings

CHROMIUM PLATING

FIELD OF THE INVENTION

A process for electrodeposition of both hard and if desired bright chrome platings with high current efficiency and plating baths for carrying out such electroplating process.

The plating bath comprises as main constituent chromium trioxide, which is used in combination with proper quantities of chlorine or its ions and/or iodine or its ions optionally with a small quantity of sulfate ions.

BACKGROUND OF THE INVENTION

Electroplating of various metals with chromium is widely used in industry. There were hitherto generally distinguished two different types of electrodeposited platings of chromium, namely:

a. Bright chromium which is a decorative and anticorrosive plating;

b. Hard chromium which serves as wear-resistant layer which increases the useful time of life of many important machine parts.

Whereas the thickness of bright chromium rarely exceeds 1 micron, platings of hard chromium may be of a thickness of the order of up to some hundreds of microns and sometimes even of some millimeters. Hard plating by means of chromium is used sometimes to restore worn-out machine parts, such as parts of ship-engines and others.

The bath which will be refered to later on as a conventional one is meant to be based principally on the U.S. Pat. No. 1,581,188 (1926) and/or on British Pat. No. 237288 (1925), including their further improvements. In the conventional bath for chrome electroplating the main constituent is chromium trioxide which is generally used in combination with sulfuric acid which serves as a catalyst. The conventional process for chrome plating has certain attractive features, such as a stable bath which is easily operated; the quality of the deposited chrome is generally high both in cases of bright chrome and hard chrome platings which however are to be obtained by means of two different versions of the conventional process.

The main drawback of the conventional process is its very low overall efficiency. Cathode current efficiency under industrial conditions rarely exceeds about 13 to 15%, while under laboratory conditions it may be up to about 20 to 25%. Thus only about 12 to 25% of the electrical energy consumed is actually utilized for the deposition of the metallic chromium while the remainder of the energy is wasted. This results also in considerable waste of time. For example, at a typical current density of about 40 $A/dm^2$ a thickness of about 20 to 25 microns may be obtained with the conventional process during about 1 hour. Thus for a layer of a thickness of about 500 microns one needs, with the conventional process, about 20–25 hours.

Besides the conventional bath which is presently most widely used in industry, some alternative plating baths are also used, among which the most well known is the "Self Regulating Speed Chrome Bath" described in 1950 by Stareck, Parsal and Mahlstedt (*Proc. Amer. Electroplat. Soc.*, vol. 37, p. 31). This process enables one to obtain a cathode current efficiency up to 22–24% which is higher than with the conventional process but still very low. Moreover this process has additional drawbacks, and the maintenance of stable properties of chrome plates during this process is difficult under industrial conditions.

It has been reported in literature that certain ions, such as $F^-$, $Cl^-$, $SiF_6^-$ etc., can be used instead of $SO_4^{2-}$ as catalysts. With regards to those other catalysts there are no adequate reports (except for $F^-$ and $SiF_6$) relating to the effect of these ions on efficiency of the process and on properties of the chrome plating thus obtained. It may be stated that hitherto no replacement for $SO_4^{2-}$ has been found.

There were described certain baths for electrodeposition of chromium using as a main constituent trivalent chromium rather than hexavalent one.

In certain cases those baths contained, besides trivalent chromium, also chlorine and several other additives as well (for example—see U.S. Pat. Nos. 3,706,636, 3,706,638 and 3,706,642) describing the use of carboxylic acid and glycolic acid together with chlorine (in trivalent chromium baths). These baths are very complicated and actually do not display advantages over the conventional baths.

There were also suggested Cl-containing baths using a non-aqueous solvent, as for example dimethylformamide (see for example J. Matulis et al., *Lit. SSR Mokslu Akad. Darb.* B1972(4) 34–40). The use of a non-aqueous solvent makes this method actually unsuitable for a wide industrial use. Moreover, the efficiency of the process is still low (about 30%).

There were described also baths based on a use of chromium chloride (in which chromium is trivalent), but not containing or almost not containing hexavalent chromium (see for example Brit. Pat. Appl. Ser. No. 25984/73).

Besides $CrCl_3$ the bath contains NaCl, $H_3BO_3$ and dimethylformamide. This bath is complicated and moreover does not display any considerable advantages as compared with the conventional one.

Also all the baths described based on a use of $F^-$ cannot in any way compete with the conventional bath.

There exist also reports describing a deterioration of chrome plating baths due to a presence of chlorine. These researches have been performed under operating conditions irrelevant to those ensuring the production of good quality chrome platings, as will be demonstrated later.

Certain more "exotic" baths for chromium electroplating have been suggested as well, for instance, the baths using perchlorates and pulsating currents etc.

However, a bath which could be considered as a substitute for the conventional one, i.e. ensuring the preparation of good quality chrome platings, with simultaneous increase of the current efficiency of the process and being easily operated under industrial conditions, has not yet been found.

It is an object of the present invention to provide an improved process of chromium electroplating which overcomes the drawbacks of the processes known hitherto and results in a considerable improvement of the current efficiency of the process.

SUMMARY OF THE INVENTION

According to the present invention there is provided a substantially improved process for electroplating with chromium, which process is characterized by a substantially improved current efficiency, reaching under certain conditions values as high as about 70% or even higher.

Due to possible interaction of the various constituents of the plating baths, the exact composition of these is not known.

In the following chlorine or its ions will be referred to as "Cl". In the following iodine or its ions will be referred to as "I". Sulfate ions will be referred to as $SO_4^{2-}$.

There are provided novel plating baths for electroplating with chromium which are prepared from chromium trioxide in combination with proper quantities of either Cl or I or both Cl+I.

There will be distinguished four types of plating baths:

a. A plating bath prepared from chromium trioxide as main constituent and Cl as second component, defined as "Chromispel C".
b. A plating bath prepared from chromium trioxide as main constituent and "I" (iodine and/or iodide) as second component, defined as "Chromispel I".
c. A plating bath containing chromium trioxide as main constituent and Cl+I as further components, defined as "Chromispel−CI".
d. Plating baths according to the above, which also contain a small quantity of sulfate ions (in the order of about 0.5 to about 2 percent by weight).

It has been found that Chromispel-C, and Chromispel-I and Chromispel-CI baths as they are defined above, result in a substantial improvement of current efficiency of the process of chromium electroplating preserving simultaneously the required quality of the electrodeposited chromium, ensuring a quality of electrodeposited chromium even exceeding that obtained with the conventional process.

The components Cl and/or I may be used in the plating baths either in the form of free Cl or/and I, or/and in the form of acids such as HCl, HI, $HIO$, $HIO_2$, $HIO_3$, $HIO_4$, or/and in the form of salts, such as KCl, KI, NaCl, NaI, MgCl, $CrCl_3$ and the like or/and in the form of solutions of Cl in water or/and of I in alcohols such as ethanol, methanol, butanol, and the like, or in any other suitable form. Other compounds containing chloride and/or iodide ions can also be used as source of $Cl^-$ or $I^-$ ions, for example $ClI_3$, $ICl_3$, etc.

In the following the various plating baths will be defined by the constituents used to make up these baths. Due to the possible interaction of various constituents, the exact composition of the baths is not known. The ratios indicated are those of the components introduced to make up the baths.

The content of chromium trioxide in the plating bath is in the range of 100 g to 1600 g per liter, and preferably in the range of 500 g to 1000 g per liter.

It is possible to state that these three types of baths may be prepared using, as an initial medium, a conventional bath, to which proper quantities of either Cl or I or both Cl and I are added, while the concentration of $CrO_3$ is desirably enlarged. The additon to conventional bath of either Cl or I or both Cl+I with simultaneous increase of the concentration of $CrO_3$ in all cases cause a considerable increase in current efficiency, as will be demonstrated in Examples presented later. Simultaneous addition of Cl and I brings about a larger increase in current efficiency than that of Cl only or I only. As to the quality of electrodeposited chromium plating, it depends on operating conditions; generally for each combination of concentrations of $CrO_3$, Cl and/or I the operating conditions exist ensuring preservation of a satisfactory quality of chrome platings as compared with the conventional bath.

For Chromispel-C bath containing as a second component (besides $CrO_3$) Cl, the ratio of $CrO_3$ to Cl (by weight) is advantageously maintained in the range from 7:1 to 330:1 and preferably 20:1 to 250:1.

For Chromispel-I bath containing as second component (besides $CrO_3$)I, the ratio of $CrO_3$ to I (by weight) is advantageously maintained in the range 10:1 to 100:1 and preferably 20:1 to 45:1.

For Chromispel-CI baths containing besides $CrO_3$, both Cl and I as further components, the ratio of $CrO_3$ to Cl (by weight) is advantageously maintained on the range of 10:1 to 330:1 while the ratio of $CrO_3$ to I (by weight) is simultaneously advantageously maintained in the range of 10:1 to 330:1; furthermore, in this Chromispel-CI bath the ratio of Cl to I (by weight) is simultaneously advantageously maintained in the range of 1 to 7, 10 to 1.

Among the three types of Chromispel baths mentioned, the Chromispel CI bath containing both Cl and I, (besides $CrO_3$) displays the most advantageous features as will be demonstrated later.

The plating baths containing besides $CrO_3$, Cl and/or I, also $SO_4^{2-}$, will be referred to in the following as sulfato-chloro (SC), as sulfato-iodo (SI) and as sulfato-chloro-iodo (SCI) baths, respectively.

It has been found that also sulfato-chloro, sulfato-iodo and sulfato-chloro-iodo baths as they are defined above, result in a substantial improvement of current efficiency of the process of chromium electroplating preserving simultaneously the required quality of the electrodeposited chromium, and in certain cases, ensuring a quality of electrodeposited chromium even exceeding that obtained with the conventional process.

For the sulfato-chloro baths, as they are defined above, the ratio of $SO_4^{2-}$ to $CrO_3$ (by weight) may be maintained in the range of 0.01 to 0.02; simultaneously the ratio of $CrO_3$ to Cl (by weight) is advantageously maintained in the range of 100:2 and 100:10.

For sulfato-iodo baths, as they are defined above, the ratio of $SO_4^{2-}$ to $CrO_3$ (by weight) may be maintained in the range of 0.01 to 0.02, simultaneously the ratio of $CrO_3$ to I (by weight) is advantageously maintained in the range of 100 to 1 and 100 to 5.

For sulfato-chloro-iodo baths as they defined above, the ratio of $SO_4^{2-}$ to $CrO_3$ (by weight) may be maintained in the range of 1:100 to 2:100; simultaneously the ratio of $CrO_3$ to Cl (by weight) is advantageously maintained in the range of 100:2 to 100:10 and the ratio of $CrO_3$ to I (by weight) is advantageously maintained in the range of 100:2 to 100:5.

Summarizing what is advised above with respect to sulfato-chloro, sulfato-iodo and sulfato-chloro-iodo baths, it is possible to state that these three types of baths may be prepared using, as an initial medium, a conventional bath, to which proper quantities of either Cl or I or both Cl and I are added, while the concentration of $CrO_3$ is advantageously enlarged. The addition to conventional baths of either Cl or I or both Cl + I with simultaneous increase of the concentration of $CrO_3$ in all cases cause a considerable increase in current efficiency, as will be demonstrated in Examples presented later. Simultaneous addition of Cl and I brings about larger increase in current efficiency than that of Cl only or I only. As to the quality of electrodeposited chromium plating, it depends on operating conditions; generally for each combination of concentrations of $CrO_3$, $SO_4^{2-}$, Cl and/or I the operating conditions exist ensuring preservation of a satisfactory quality of chrome platings as compared with the conventional bath.

It is one of the main advantages of the present invention that when plating baths according to the invention are used, it is possible to attain a considerably improved current efficiency. It has been discovered that current efficiencies of about 30 percent and in some cases efficiencies as high as about 70 percent and even more can be attained. Good quality deposits are obtained.

The invention is illustrated with reference to the following examples which are to be construed in a non-limitative manner.

In the following examples, the numerical values are approximative ones. In most cases a number of runs was carried out, giving approximately the same results. The numerical values are average values obtained in such runs.

EXAMPLES

A. Chromispel-C Plating Baths

EXAMPLE 1

A plating bath containing 740 g/liter of $CrO_3$ and 100 ml per liter of HCl (32% solution) (i.e. a weight ratio of $CrO_3$:Cl was 20.4). The electroplating was carried out at 20° C. and at 40 $A/dm_2$, current efficiency was 72% and hardness was 1200 (Vicker Diamond Scale, load 200 g).

The deposits at the thickness of about 60 microns were dull but very smooth.

EXAMPLE 2

The plating bath contained 750 g/liter of $CrO_3$ and 67 g/liter of $CrCl_3$. Current density was 36 $A/dm_2$, temperature 45° C. Current efficiency attained was 55%, hardness 700 (VDS); the deposit at the thickness of about 50 microns was dull but smooth.

EXAMPLE 3

The plating bath contained 800 g/liter of $CrO_3$ and 80 ml/liter of HCl (32%). Plating was carried out at 21° C. and 53 $A/dm^2$. Current efficiency was 76% and hardness of chromium plate 700 (VDS).

EXAMPLE 4

The plating bath contained 800 g/l $CrO_3$, NaCl 63 g/l and plating was carried out at 23° C., at 37.4 $A/dm^2$, current efficiency was 70%.

EXAMPLE 5

The plating bath contained 1000 g per liter of chromium trioxide, 100 ml of HCl (32%) per liter and the electroplating was carried out at 21° C. at a current density of 15.8 $A/dm^2$. The current efficiency was 78.4% and the VDS hardness was 960. The deposit at the thickness of about 120 microns was dull but smooth.

EXAMPLE 6

The plating bath contained 922 g/liter of chromium trioxide and 90 ml (32% solution) of HCl. The electroplating was effected at 19° C. at a current density of 39 $A/dm^2$. Current density was 72.2% and hardness of the chromium deposit was 920 (VDS). The deposit at the thickness of about 130 microns was semi-bright and highly smooth.

Chromispel-C baths prepared from only $CrO_3$ and Cl give best current efficiencies at temperature of about 20° C. At higher temperatures the efficiency decreases gradually and the hardness of the deposits decreases as well. Thus plating from this type of Chromispel bath is satisfactory at temperatures not exceeding about 22°-24° C.

For Chromispel-C bath the current density is not a critical parameter. It was found that plating at current densities varying from 6 $A/dm^2$ to 120 $A/dm^2$ did not result in substantial differences of efficiencies. In the entire range plating efficiency remained about 60% and this is an additional important advantage of the novel process.

The optimum results with Chromispel-C baths are attainable with quite concentrated plating baths (750–100 g/l of $CrO_3$), and the most favorable range seems to be the ratio $CrO_3$/Cl about 20:1 to 30:1 by weight, temperature about 18°–30° C. and a current density about 15–50 $A/dm^2$.

B. Chromispel-I Plating Baths

EXAMPLE 7

The plating bath contained 700 g per liter of chromium trioxide and 25 g per liter of I which was supplied in the form of 57% HI. Current density was 36 $A/dm^2$ and temperature 24° C. The cathode current efficiency attained was about 60%, the chromium deposits were semi-bright (on a dull substrate). Hardness was 900 (VDS).

EXAMPLE 8 the plating bath was prepared from 830 g/liter of $CrO_3$ plus 10 g/liter of $HIO_3$. The current density was about 40 $A/dm^2$, temperature about 40° C. The cathode current efficiency attained was about 53%, the microhardness was about 900 (VDS).

C. Chromispel-C-I Plating Baths

For Chromispel-I bath containing only I as a second component the efficiency attained was a little lower than that with Cl-containing bath albeit still much higher than with the conventional process, and higher than with sulfato-chloro, sulfato-iodo and sulfato-chloro-iodo baths. The best results have been obtained with this type of bath at temperatures about 24°–50° C., which are higher than for the Cl-containing bath. The surface of chrome plates was usually smoother than in the case of the Chromispel-C bath and possess certain degree of brightness. The Chromispel-I bath as a rule ensures higher hardness of the deposit that Chromispel-C bath.

EXAMPLE 9

The plating bath contained 700 g/liter of chromium trioxide, 3 g/liter of Cl (supplied in the form of 32% HCl) and 25 g/liter of I (supplied in the form of a solution in ethanol). The current density was 36 $A/dm^2$ and temperature 30° C. The cathode current efficiency attained was about 63%, hardness of chrome plate was about 1000 (VDS). The deposits were bright (on non-bright substrate).

EXAMPLE 10

The plating bath contained 850 g/liter of chromium trioxide, 10 g/liter of Cl (supplied in the form of 32% HCl) and 5 g/liter of I (supplied in the form of 57% HI). Current density was 36 $A/dm^2$, temperature 30° C. The cathode current density attained was about 70%, hardness about 850 (VDS), deposit was very smooth and bright even at thickness of about 100 mm.

EXAMPLE 11

The plating bath contained 830 g per liter of chromium trioxide, 36 ml per liter of 32% HCl and 5 ml per liter of 57% HI. Temperature was 31° C., current density 36 A/dm$^2$. Cathode current efficiency attained was 71%, hardness of the deposit was about 950 (VDS) while deposit did not display and signs of brittleness, at thickness of about 200 microns the deposit still was mirror-like bright with extremely smooth surface (the substrate was made of non-smoothed copper).

EXAMPLE 12

The plating bath contained 830 g per liter of $CrO_3$, 26, 5 ml per liter of 32% HCl and 5 ml per liter of 57% HI. Current density was 240 A/dm$^2$. Temperature was in one case about 50° C. and in another was about 30° C.

In the case of 50° C. temperature the thickness of about 390 microns was attained during 30 min.; this means the rate of deposition of about 780 microns per hour, and current efficiency of about 70%. In the case of 30° C. temperature the thickness of about 360 microns was attained during 30 min.; this means the rate of deposition of about 720 microns per hour and current efficiency of about 65%. In both cases the substrate was made of non-bright copper. At the mentioned thicknesses of about 390 microns and 360 microns respectively the deposits were bright. Hardness of deposits in both cases was about 950 (VDS). The deposits were microporous.

EXAMPLE 13

The plating bath was prepared from 850 g/liter of $CrO_3$ plus 10 g/liter of the solid compound $ICl_3$. The deposition of chromium was performed at a current density of 36 A/dm$^2$, at a temperature of 52° C. The cathode efficiency attained was about 61%, microhardness of the chrome deposited was about 950 (VDS).

EXAMPLE 14

The bath was prepared from 850 g/liter of $CrO_3$ and 26.5 ml per liter of 32% HCl plus 7 g/liter of $HIO_3$. The current density was 36 A/dm$^2$, temperature 48° C. Cathode efficiency attained was about 61%, microhardness of the chrome deposited was about 1000 (VDS).

EXAMPLE 15

The plating bath was prepared from 850 g/liter of $CrO_3$ plus 26.5 ml per liter of 32% HCL plus 2.5 g/liter of solid free $I_2$ plus 3.5 g/liter of $HIO_3$. The current density was 36 A/dm$^2$, temperature about 45° C. The cathode efficiently attained was about 62%, microhardness about 975 (VDS).

Chromispel-CI baths containing besides $CrO_3$ also Cl as a second and I as a third component display especial advantages; namely, in this bath there are simultaneously attained high current efficiency (70% or more), high hardness of the deposits (up to about 1000 on VDS) with only a limited brittleness, good adhesion to the substrate, high smoothness of the deposit surface which is bright even at thicknesses of several hundreds of microns.

With the preferable ranges of current densities (5-250 A/dm$^2$), temperatures (25°–55° C.) and concentrations of ingredients (as indicated above) the efficiency is always not less than 60% (with a maximum of about 78%) and hardness is always not less than about 820 (with a maximum of about 1100).

The Chromispel-CI baths are only to a very limited extent sensitive to small impurities present in chromium trioxide of technical grade of purity and therefore stable results are ensured with regard to efficiency and deposit properties obtained.

Finally, the Chromispel-CI process is the first one combining in itself possibilities to obtain in the same bath both hard and bright chrome platings.

D: PLATING BATHS CONTAINING SULFATE IONS

EXAMPLE 16

The plating bath contained 250 g/liter $CrO_3$. 2,5 g/liter $SO_4^{2-}$ and 25 g/l of Cl (introduced in the form of 32% HCl). Current density was 35 A/dm$^2$, temperature 28° C. Cathode current efficiency attained was 42%; hardness of the deposit was 650 (Vickers Diamond Scale). At the thickness of about 100 micron deposit was dull but smooth.

EXAMPLE 17

The plating bath contained 250 g/liter of $CrO_3$, 2,5 g/liter of $SO_4^{2-}$ and 5 g/liter of I (introduced in the form of 57% HI). Current density was 35 A/dm$^2$, temperature 30° C. Current efficiency obtained was 38%, hardness of the deposit was 810 (Vickers Diamond Scale). At the thickness of about 80 micron the deposit was dull, but smooth.

EXAMPLE 18

The plating bath contained 250 g/liter of $CrO_3$, 2,5 g/liter of $SO_4^{2-}$, 10 g/liter of Cl (introduced in the form of 32% HCl) and 5 g/liter of I (introduced in the form of 57% HI). Current density was 35 A/dm$^2$, temperature 32° C. Current efficiency attained was 43%, hardness of the deposit 800 (VDS). The deposit of the thickness of about 80 microns was dull, but smooth.

EXAMPLE 19

The plating bath contained 500 g/liter of $CrO_3$. 2,5 g/liter of $SO_4^{2-}$, 20 g/liter of Cl (introduced as 32% HCl) and 15 g/liter of I (introduced as 57% HI). Current density was 35 A/dm$^2$, temperature 27° C. Current efficiency attained was 58%, hardness of the deposit—850 (VDS). The deposit at the thickness of about 70 micron was dull but smooth.

We claim:

1. A plating bath for electroplating various metals with chromium, consisting essentially of the composition resulting from the combination of 100–1600 g/l of chromium trioxide and one or more of the following:

0.3–15 weight % Cl or $Cl^-$ based on the chromium trioxide, and 0.5–10 weight % I or $I^-$ based on the chromium trioxide.

2. A plating bath in accordance with claim 1 in which no sulfate has been added.

3. A plating bath according to claim 2, wherein said composition results from the combination of from 250 to 500 g chromium trioxide and from 2.5 to 10 weight percent of Cl or $Cl^-$ calculated on the chromium trioxide.

4. A plating bath according to claim 2, wherein said composition results from the combination of from 250 to 1000 g chromium trioxide per liter water and from 1 weight percent to 10 weight percent I or $I^-$ calculated on the chromium trioxide.

5. A plating bath according to claim 2, wherein said composition results from the combination of from 250 g to 1000 g chromium trioxide per liter water, from 0.3 weight percent to 10 weight percent Cl or $Cl^-$ calculated on the chromium trioxide and 0.3 to 10 weight percent I or $I^-$ calculated on the chromium trioxide.

6. A plating bath in accordance with claim 4 or 5, wherein the I or $I^-$ is added as HI, HIO, $HIO_2$, $HIO_3$, $HIO_4$, KI, $KIO_3$, or NaI.

7. A plating bath in accordance with claim 5, wherein the Cl or $Cl^-$ and the I or $I^-$ are added as ClI or $ICl_3$.

8. A plating bath according to claim 1, wherein the amount of chromium trioxide combined to result in said composition comprises from 250 to 1000 g chromium trioxide per liter water.

9. A plating bath according to claim 8 wherein said composition results from the further inclusion of from 0.3 to 2 weight percent sulfate ions calculated on the chromium trioxide.

10. A plating bath according to claim 1, wherein the constituents Cl, $Cl^-$, I and $I^-$, when present, are chosen from the group consisting of HCl, HI, HIO, $HIO_2$, $HIO_3$, $HIO_4$, KCl, KI, NaCl, $KIO_3$, NaI, $MgCl_2$, $CrCl_3$, ClI, and $ICl_3$.

11. A process for electroplating with chromium wherein the electroplating is effected in a plating bath according to claim 1, at a temperature from ambient temperature to a temperature of 60° C., at a current density of from 10 $A/dm^2$ to 270 $A/dm^2$.

12. A process according to claim 11, wherein the electroplating is effected at a current density from 30 to 250 $A/dm^2$ and at 25° C. to 50° C.

* * * * *